US008157616B2

(12) United States Patent
Shimizu et al.

(10) Patent No.: US 8,157,616 B2
(45) Date of Patent: Apr. 17, 2012

(54) POLISHING END POINT DETECTION METHOD

(75) Inventors: Noburu Shimizu, Tokyo (JP); Shinrou Ohta, Tokyo (JP)

(73) Assignee: Ebara Corporation, Tokyo (JP)

( * ) Notice: Subject to any disclaimer, the term of this patent is extended or adjusted under 35 U.S.C. 154(b) by 437 days.

(21) Appl. No.: 12/476,427

(22) Filed: Jun. 2, 2009

(65) Prior Publication Data

US 2009/0298387 A1 Dec. 3, 2009

(30) Foreign Application Priority Data

Jun. 3, 2008 (JP) ..... 2008-145746

(51) Int. Cl.
*B24B 49/12* (2006.01)

(52) U.S. Cl. ..... 451/8; 451/5; 451/6

(58) Field of Classification Search ..... 451/5, 6, 451/8, 41, 10, 11, 57, 28
See application file for complete search history.

(56) References Cited

U.S. PATENT DOCUMENTS 6,111,634 A 8/2000 Pecen et al.
6,190,234 B1 * 2/2001 Swedek et al. ..... 451/6
6,618,130 B2 * 9/2003 Chen ..... 356/73
7,018,271 B2 * 3/2006 Wiswesser et al. ..... 451/8
7,252,575 B2 * 8/2007 Kobayashi et al. ..... 451/6
7,406,394 B2 7/2008 Swedek et al.
7,438,627 B2 * 10/2008 Kobayashi et al. ..... 451/5
7,645,181 B2 * 1/2010 Kobayashi et al. ..... 451/5

FOREIGN PATENT DOCUMENTS

WO 2008/044786 4/2008

* cited by examiner

*Primary Examiner* — Dung Van Nguyen
(74) *Attorney, Agent, or Firm* — Wenderoth, Lind & Ponack, L.L.P.

(57) ABSTRACT

A method for detecting an end point of a polishing operation (e.g., a polishing stop point or a changing point of polishing conditions) of a film of a substrate is described. The method includes applying light to a surface of a substrate during polishing of the substrate; receiving reflected light from the surface of the substrate, monitoring a first characteristic value and a second characteristic value calculated from reflection intensities at different wavelengths; detecting a point when an extremal point of the first characteristic value and an extremal point of the second characteristic value appear within a predetermined time difference; after detecting the point, detecting a predetermined extremal point of the first characteristic value or the second characteristic value; and determining a polishing end point based on a point when the predetermined extremal point is detected.

14 Claims, 7 Drawing Sheets

POLISHING END POINT DETECTION METHOD

BACKGROUND OF THE INVENTION

1. Field of the Invention

The present invention relates to a polishing end point detection method, and more particularly to an optical polishing end point detection method for detecting an end point of a polishing operation (e.g., a polishing stop point or a changing point of polishing conditions) of a film of a substrate.

2. Description of the Related Art

In a semiconductor fabrication process, a CVD apparatus is widely used for forming an oxide film on a wafer. In this film formation process, wafers are processed on a lot basis. Typically, twenty-five wafers are processed as one lot. In one lot, a thickness of the oxide film does not greatly vary between wafers. However, when several tens of lots are processed, the thickness of the oxide film may vary within plus or minus 10% due to a change with time in consumable member or temperature in a film-forming apparatus.

Further, in a case where the film-forming apparatus has multiple chambers for the film-forming operations, the thickness of the film can also vary between the chambers. It is not particularly problematic when the deposited film is thin. However, when the film is thick, an initial thickness thereof can greatly vary between the wafers. For example, when the film is made to have an initial thickness of 1800 nm, the initial thickness may vary within plus or minus 180 nm. Such variations in the initial thickness can present a problem of an error in polishing end point detection.

An optical polishing end point detection method is generally used for detecting the polishing end point of the oxide film. An example of the optical polishing end point detection method will be described below with reference to FIG. 1. In the optical polishing end point detection method, light is applied to a surface of a film during polishing of the film, and a characteristic value is calculated using an intensity of the reflected light (i.e., a reflection intensity). This characteristic value is calculated by dividing a reflection intensity at a predetermined wavelength by a reflection intensity at another predetermined wavelength. The characteristic value is a value obtained through a process of removing noise components from the reflection intensity. This characteristic value changes periodically according to a change in the film thickness. This is because of interference between a light ray reflected off the surface of the film and a light ray reflected off a surface of an underlying layer underneath the film.

A horizontal axis in FIG. 1 indicates a polishing time (or a film thickness), and a vertical axis indicates the characteristic value. As shown in FIG. 1, as the polishing process progresses, the characteristic value changes in a sine-curve pattern. At an initial stage of the polishing process, a waveform of the characteristic value may be unstable due to an unstable polishing phase and noises. Therefore, a start point of monitoring the characteristic value is intentionally delayed, so that monitoring of the characteristic value is not started until the polishing process progresses to a certain degree.

After monitoring of the characteristic value is started, the number of local maximum points (or local minimum points) is counted. When a predetermined number of local maximum points appear, the polishing operation is terminated. In FIG. 1, a fourth local maximum point V is preset as the polishing end point. Therefore, when the count of the local maximum points reaches four after monitoring is started, the polishing operation is terminated.

FIG. 2 is a graph showing a characteristic value in a case of polishing a film with a large initial thickness as compared with the film in the case of FIG. 1. Due to the large initial film thickness, a first local maximum point I is shifted to appear after the monitoring start point. Consequently, a fourth local maximum point IV is determined to be a polishing end point. As a result, a local maximum point V, which is an original polishing end point, is not detected, and this results in insufficient polishing of the film. On the other hand, when the film has a small initial thickness, a local maximum point II is shifted to appear before the monitoring start point. Consequently, a third local maximum point V is not determined to be a polishing end point, and this results in excessive polishing of the film. An amount of such shift of the local maximum point is also affected by a polishing rate. Therefore, in order to avoid an error in the polishing end point detection, it is necessary to measure the initial thickness and the polishing rate beforehand even if wafers have an identical device structure and to alter a recipe for the polishing end point detection based on the measurement results. These procedures make management of the polishing operations complicated and lower productivity.

SUMMARY OF THE INVENTION

The present invention has been made in view of the above drawbacks. It is therefore an object of the present invention to provide a polishing end point detection method capable of detecting a polishing end point accurately without being affected by the initial film thickness and the polishing rate.

One aspect of the present invention for achieving the above object is to provide a method for detecting a polishing end point. The method includes: applying light to a surface of a substrate during polishing of the substrate; receiving reflected light from the surface of the substrate; monitoring a first characteristic value and a second characteristic value calculated from reflection intensities at different wavelengths; detecting a point when an extremal point of the first characteristic value and an extremal point of the second characteristic value appear within a predetermined time difference; after detecting the point, detecting a predetermined extremal point of the first characteristic value or the second characteristic value; and determining a polishing end point based on a point when the predetermined extremal point is detected.

In a preferred aspect of the present invention, the point when an extremal point of the first characteristic value and an extremal point of the second characteristic value appear within the predetermined time difference is a point when an extremal point of the first characteristic value and an extremal point of the second characteristic value appear at substantially the same time.

In a preferred aspect of the present invention, the polishing end point is the point when the predetermined extremal point is detected.

In a preferred aspect of the present invention, the polishing end point is a point when a predetermined time has elapsed from the point when the predetermined extremal point is detected.

Another aspect of the present invention is to provide a method for detecting a polishing end point. The method includes: applying light to a surface of a substrate during polishing of the substrate; receiving reflected light from the surface of the substrate; monitoring a first reflection intensity and a second reflection intensity at different wavelengths; detecting a point when an extremal point of the first reflection intensity and an extremal point of the second reflection intensity appear within a predetermined time difference; after detecting the point, detecting a predetermined extremal point of the first reflection intensity or the second reflection intensity; and determining a polishing end point based on a point when the predetermined extremal point is detected.

In a preferred aspect of the present invention, the point when an extremal point of the first reflection intensity and an extremal point of the second reflection intensity appear within the predetermined time difference is a point when an extremal point of the first reflection intensity and an extremal point of the second reflection intensity appear at substantially the same time.

In a preferred aspect of the present invention, the polishing end point is the point when the predetermined extremal point is detected.

In a preferred aspect of the present invention, the polishing end point is a point when a predetermined time has elapsed from the point when the predetermined extremal point is detected.

A relative position between a locus of the first characteristic value and a locus of the second characteristic value, which are described with the polishing time, is constant irrespective of the initial film thickness and the polishing rate. Therefore, according to the present invention, an accurate detection of the polishing end point can be performed without being affected by the initial film thickness and the polishing rate.

DETAILED DESCRIPTION OF THE PREFERRED EMBODIMENTS

Figure 1:
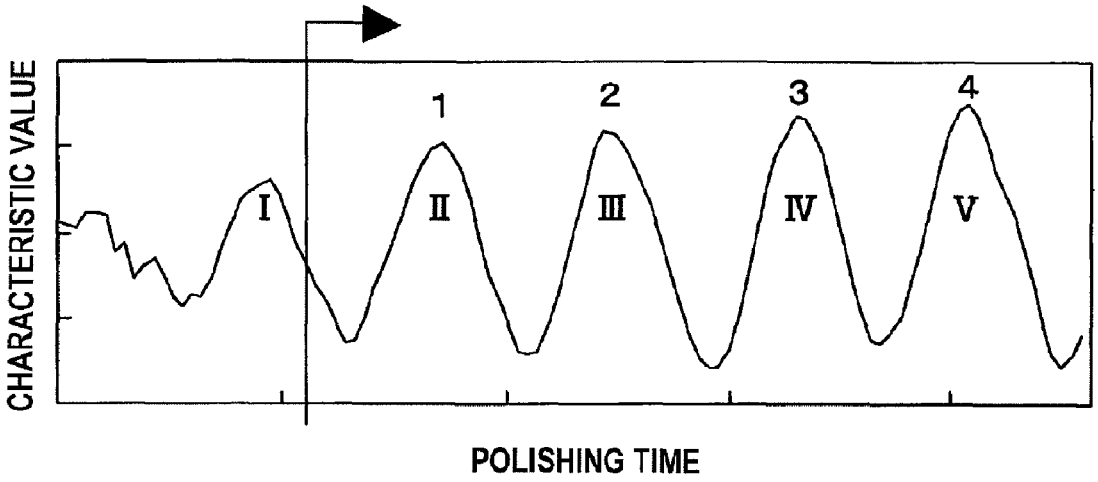
FIG. 1 is a graph illustrating a conventional polishing end point detection method.
Figure 2:
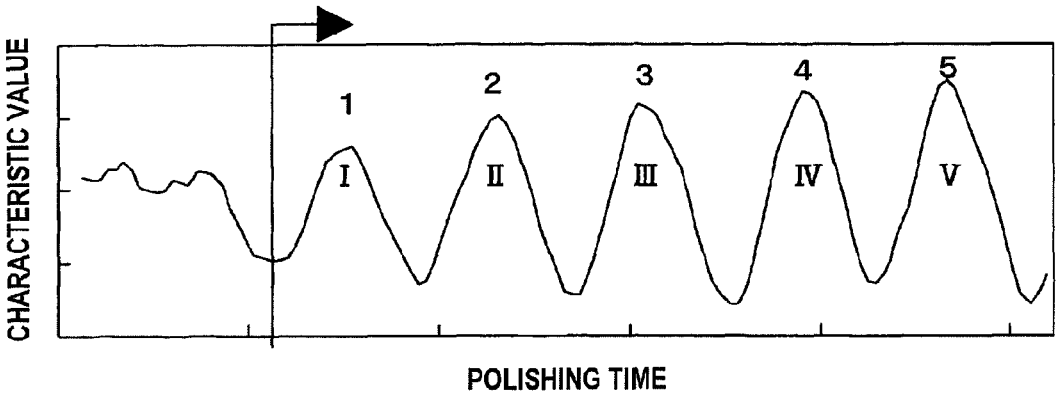
FIG. 2 is a graph illustrating the conventional polishing end point detection method.

Embodiments of the present invention will be described below with reference to FIG. 3 through FIG. 7. Identical or corresponding elements will be denoted by an identical reference numeral, and repetitive description thereof will be omitted.

Figure 3:
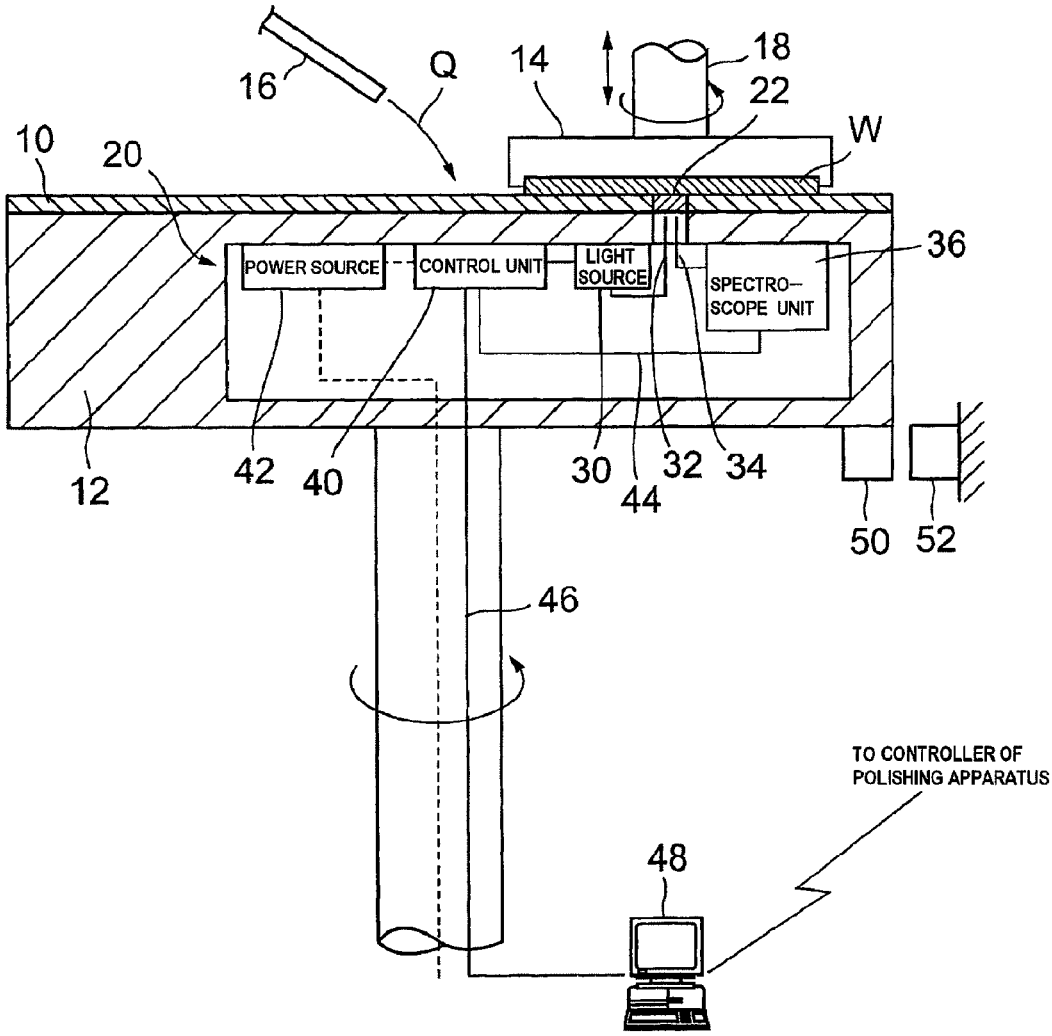
FIG. 3 is a schematic view showing an entire structure of a polishing apparatus for performing a polishing end point detection method according to an embodiment of the present invention.

FIG. 3 is a schematic view showing an entire structure of a polishing apparatus. As shown in FIG. 3, the polishing apparatus has a polishing table 12 with a polishing pad 10 attached to an upper surface thereof, and a top ring 14 for holding a wafer (substrate) W, which is a workpiece (i.e., an object to be polished) and pressing the wafer W against an upper surface of the polishing pad 10. The upper surface of the polishing pad 10 serves as a polishing surface used to provide sliding contact with the wafer W. An upper surface of a fixed abrasive plate containing fine abrasive particles (made of $CeO_2$ or the like) fixed by a binder, such as resin, may be used as a polishing surface.

The polishing table 12 is coupled to a motor (not shown) disposed therebelow, and is rotatable about its own axis as indicated by arrow. A polishing liquid supply nozzle 16 is disposed above the polishing table 12, so that a polishing liquid Q is supplied from the polishing liquid supply nozzle 16 onto the polishing pad 10.

The top ring 14 is coupled to a top ring shaft 18, which is coupled to a motor and an elevating cylinder (not shown). The top ring 14 can thus be vertically moved as indicated by arrow and rotated about the top ring shaft 18. The wafer W is attracted to and held on a lower surface of the top ring 14 by a vacuum suction or the like. With this configuration, the top ring 14 can press the wafer W on the lower surface thereof against the polishing pad 10 at a predetermined pressure, while rotating about its own axis.

During the polishing operation by the above-described polishing apparatus, the wafer W, held on the lower surface of the top ring 14, is pressed against the polishing pad 10 on the upper surface of the rotating polishing table 12, while the polishing liquid Q is supplied onto the polishing pad 10 from the polishing liquid supply nozzle 16. In this manner, the wafer W is polished with the polishing liquid Q being present between the surface (lower surface) of the wafer W and the polishing pad 10.

The polishing table 12 has a polishing state monitoring apparatus 20 embedded therein for monitoring a polishing state of the wafer W during polishing of the wafer W. This polishing state monitoring apparatus 20 is configured to monitor a polishing situation of the surface (a thickness and a state of the remaining film) of the wafer W continuously in real-time during polishing of the wafer W.

A light transmission section 22 for transmitting light from the polishing state monitoring apparatus 20 therethrough is attached to the polishing pad 10. The light transmission section 22 is made of a material of high transmittance, e.g., non-foamed polyurethane or the like. Alternatively, the light transmission section 22 may be in the form of a transparent liquid flowing upwardly into a through-hole that is formed in the polishing pad 10. In this case, the liquid is supplied into the through-hole when the through-hole is being closed by the wafer W. The light transmission section 22 may be located in any position on the polishing table 12 as long as it can travel across the surface of the wafer W held by the top ring 14. However, it is preferable that the light transmission section 22 be located in a position where it passes through a center of the wafer W.

As shown in FIG. 3, the polishing state monitoring apparatus 20 includes a light source 30, a light-emitting optical fiber 32 as a light-emitting section for directing light from the light source 30 to the surface of the wafer W, a light-receiving optical fiber 34 as a light-receiving section for receiving reflected light from the surface of the wafer W, a spectroscope unit 36 including a spectroscope for decomposing the light, received by the light-receiving optical fiber 34, according to wavelength and a plurality of light-receiving elements for storing the light decomposed by the spectroscope as electric data, a control unit 40 for controlling timing of turning on and off the light source 30 or starting to read the light-receiving elements in the spectroscope unit 36, and a power source 42 for supplying electric power to the control unit 40. The light source 30 and the spectroscope unit 36 are supplied with electric power via the control unit 40.

A light-emitting end of the light-emitting optical fiber 32 and a light-receiving end of the light-receiving optical fiber 34 are arranged to be substantially perpendicular to the surface of the wafer W. The light-emitting optical fiber 32 and the light-receiving optical fiber 34 are arranged so as not to project above the upper surface of the polishing table 12, in order to facilitate replacement operations for the polishing pad 10 and to avoid a reduction in amount of the light received by the light-receiving optical fiber 34. A photodiode array with 512 elements may be used as the light-receiving elements in the spectroscope unit 36.

The spectroscope unit 36 is coupled to the control unit 40 via a cable 44. The information from the photodetectors of the spectroscope unit 36 is transmitted to the control unit 40 via the cable 44. Based on the information, the control unit 40 generates spectral data of the reflected light. Specifically, the control unit 40 according to the present embodiment serves as a spectral data generator configured to read the electrical information stored in the photodetectors and generate spectral data of the reflected light. A cable 46 extends from the control unit 40 through the polishing table 12 to a processor 48, which is a personal computer, for example. The spectral data generated by the spectral data generator of the control unit 40 are transmitted to the processor 48 through the cable 46.

Based on the spectral data received from the control unit 40, the processor 48 calculates a characteristic value of the surface of the wafer W. The characteristic value is an index indicating a polishing state of the surface of the substrate. The processor 48 also has a function of receiving information about polishing conditions from a controller (not shown) which controls the polishing apparatus, and a function of determining a polishing end point (stop of polishing or a change of the polishing conditions) based on time variation of the calculated characteristic value and sending a command to the controller of the polishing apparatus. In this polishing apparatus, the polishing state monitoring apparatus 20 and the processor 48 constitute a polishing end point detection apparatus.

As shown in FIG. 3, a proximity sensor 50 is mounted on a lower end of the polishing table 12 in a position near its circumferential edge, and a dog 52 is mounted outwardly of the polishing table 12 in alignment with the proximity sensor 50. Each time the polishing table 12 makes one revolution, the proximity sensor 50 detects the dog 52 to thereby determine a rotation angle of the polishing table 12.

The light source 30 comprises a light source configured to emit light having a wavelength range including white light. For example, a pulsed light source, such as a xenon lamp, can be used as the light source 30. When the pulsed light source is used as the light source 30, the light source 30 emits pulsed light at each measuring point according to a trigger signal during a polishing process. Alternatively, a tungsten lamp may be used as the light source 30. In this case, the light source 30 may emit light continuously at least when the light-emitting end of the light-emitting optical fiber 32 and the light-receiving end of the light-receiving optical fiber 34 are facing the surface of the wafer W.

Light from the light source 30 travels through the light-emitting end of the light-emitting optical fiber 32 and the light transmission section 22, and is applied to the surface of the wafer W. The light is reflected off the surface, being polished, of the wafer W, passes through the light transmission section 22, and is received by the light-receiving optical fiber 34 of the polishing state monitoring apparatus 20. The light, received by the light-receiving optical fiber 34, is transmitted to the spectroscope unit 36, which divides the light into a plurality of light rays according to wavelengths. The divided light rays having respective wavelengths are applied to the photodetectors corresponding to the wavelengths, and the photodetectors store electric charges according to quantities of the light rays applied. The electrical information stored in the photodetectors is read (released) at a predetermined timing, and converted into a digital signal. The digital signal is sent to the spectral data generator of the control unit 40, and the control unit 40 generates spectral data corresponding to respective measuring points.

Figure 4:
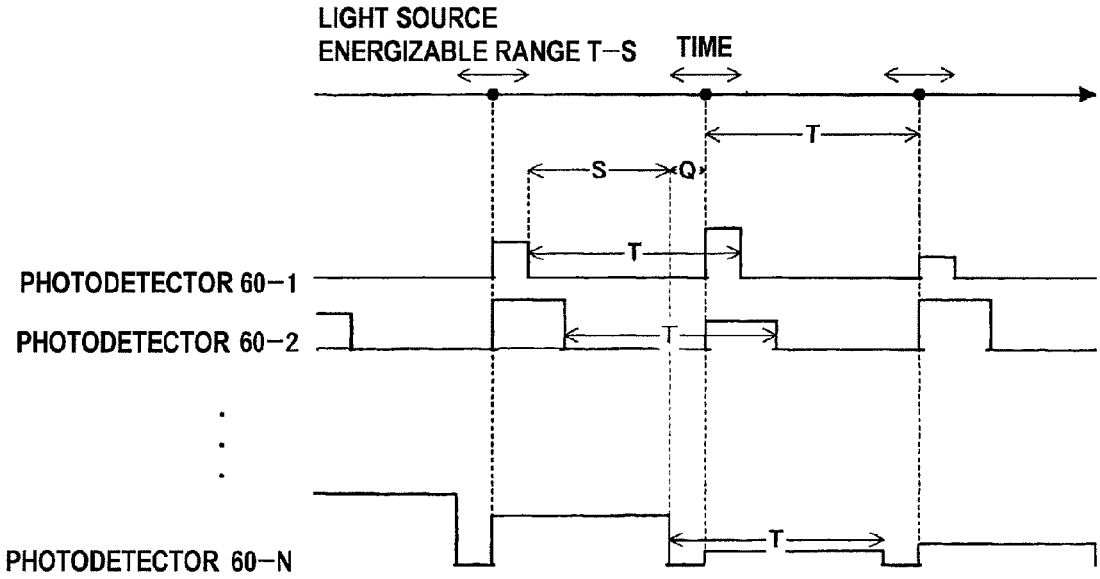
FIG. 4 is a diagram showing the operation of light-receiving elements in a spectroscope unit in a case where a pulsed light source is used in a polishing state monitoring apparatus shown in FIG. 3.
Figure 5:
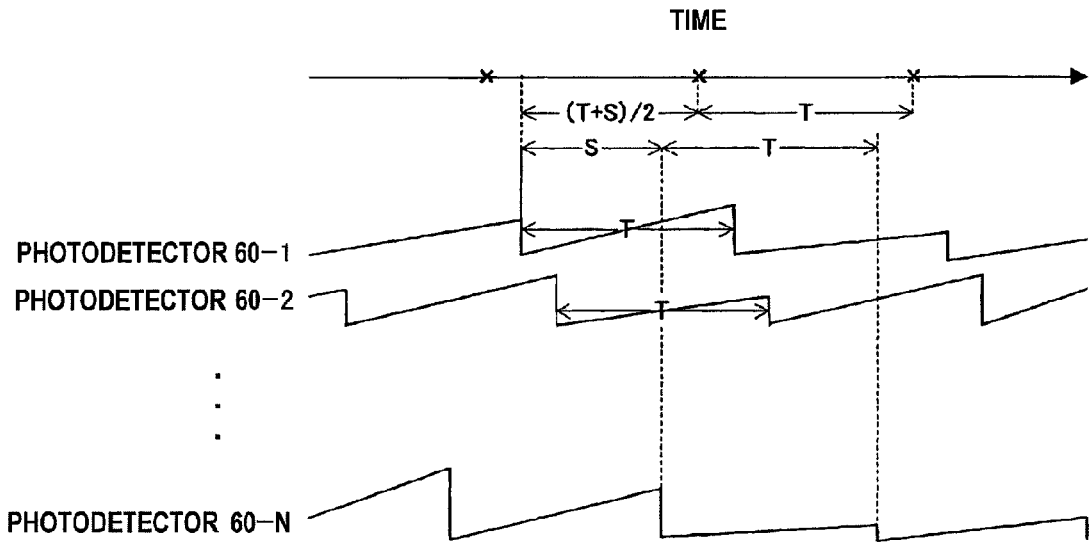
FIG. 5 is a diagram showing the operation of light-receiving elements in a spectroscope unit in a case where a continuous light source is used in the polishing state monitoring apparatus shown in FIG. 3.

Operation of the photodetectors of the spectroscope unit 36 will be described below. FIGS. 4 and 5 are diagrams showing an operating manner of the photodetectors in a case where the spectroscope unit 36 has photodetectors 60-1 through 60-N (the total number is N). More specifically, FIG. 4 shows a case where the pulsed light source is used as the light source 30, and FIG. 5 shows a case where the continuous light source is used as the light source 30. In FIGS. 4 and 5, horizontal axis represents time, and rising portions of graphs show that the electrical information is stored in the photodetectors, and falling portions show that the electrical information is read (released) from the photodetectors. In FIG. 4, black circles (●) indicate times when the pulsed light source is turned on.

In one sampling cycle, the photodetectors 60-1 through 60-N are successively switched from one to another to read (release) the electrical information therefrom. As described above, the photodetectors 60-1 through 60-N store the quantities of light rays of the corresponding wavelengths as the electrical information, and the stored electrical information is repeatedly read (released) from the photodetectors 60-1 through 60-N at a sampling period T with phase difference therebetween. The sampling period T is set to be relatively small, insofar as sufficient quantities of light are stored as electrical information in the photodetectors 60-1 through 60-N and data read from the photodetectors 60-1 through 60-N can sufficiently be processed in real-time. When an array of 512 photodiodes is used as the photodetectors, the sampling period T is on the order of 10 milliseconds.

In FIGS. 4 and 5, "S" represents a time from when the first photodetector 60-1 is read to when the last photodetector 60-N is read, where $S<T$. In the case of FIG. 4, the time (indicated by ● in FIG. 4) when the pulsed light source is turned on is a sampling time. In the case of FIG. 5, the time (indicated by "x" in FIG. 5) that is half the time after the first photodetector 60-1 is read and starts storing new electrical information until the last photodetector 60-N is read is a sampling time for corresponding measuring areas. Points on the wafer W which face the light transmission section 22 (or the through-hole) at the sampling times will be referred to as sampling points.

In FIG. 4, all the photodetectors 60-1 through 60-N store light while the light source 30 lights up instantaneously (for about several microseconds). Where Q represents the time from when the electrical information stored in the last photodetector 60-N is read (released) to when the light source 30 is turned on, if the light source 30 is tuned on before the electrical information stored in the first photodetector 60-1 is read (released), an inequality $0<Q<T-S$ holds. While Q can take any value within the range indicated by the above inequality, the following descriptions use a value of $Q=(T-S)/2$. The first photodetector 60-1 is read and starts storing new electrical information at a timing that is earlier than the sampling time by $S+Q$, i.e., $(T+S)/2$. In FIG. 5, the first photodetector 60-1 is also read at a timing that is earlier than the sampling time by $(T+S)/2$. With respect to the continuous light source shown in FIG. 5, the photodetectors 60-1 through 60-N start storing electrical information at different times, and the stored electrical information is read from the photodetectors 60-1 through 60-N at different times. Consequently, actual measuring areas slightly vary depending on the wavelengths.

Figure 6:
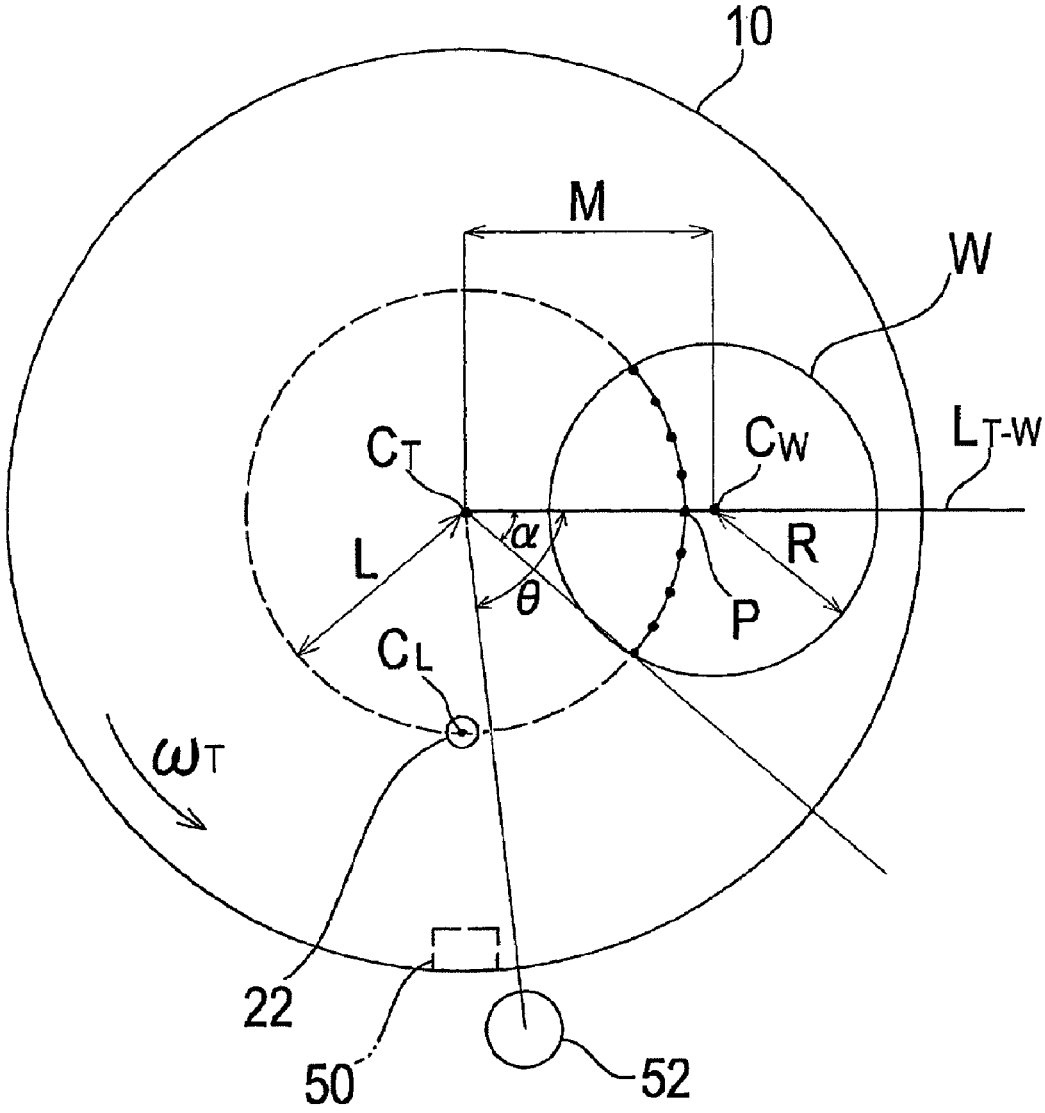
FIG. 6 is a plan view illustrative of sampling timings of the polishing state monitoring apparatus shown in FIG. 3.

Next, processes of determining a sampling timing by the polishing state monitoring apparatus 20 will be described. First, a process of determining a sampling timing in a case of using the pulsed light source will be described. FIG. 6 is a view illustrative of sampling timings of the polishing state monitoring apparatus 20. Each time the polishing table 12 makes one revolution, the proximity sensor 50 disposed on the circumferential edge of the polishing table 12 detects the dog 52 which serves as a reference position for operation of the proximity sensor 50. Specifically, as shown in FIG. 6, a rotation angle is defined as an angle, in a direction opposite to a direction of rotation of the polishing table 12, from a line $L_{T\text{-}W}$ (hereinafter referred to as a substrate center line) that interconnects the center $C_T$ of rotation of the polishing table 12 and the center $C_W$ of the wafer W. The proximity sensor 50 detects the dog 52 when the rotation angle is θ. The center $C_W$ of the wafer W can be specified by controlling the position of the top ring 14.

As shown in FIG. 6, where a horizontal distance between the center $C_T$ of the polishing table 12 and the center $C_L$ of the light transmission section 22 is represented by L, a horizontal distance between the center $C_T$ of the polishing table 12 and the center $C_W$ of the wafer W is represented by M, a radius of a measuring target surface of the wafer W which is the surface, to be polished, of the wafer W excluding an edge cut region thereof is represented by R, and an angle at which the light transmission section 22 scans the measuring target surface of the wafer W is represented by 2α, the following equation (1) holds based on the cosine theorem, and the angle α can be determined from the following equation (1).

$$\alpha = \cos^{-1}\left(\frac{L^2 + M^2 - R^2}{2LM}\right) \tag{1}$$

In the present embodiment, sampling timings are adjusted such that a point P on the substrate center line $L_{T\text{-}W}$ through which the light transmission section 22 passes is always selected as a sampling point. Where the number of sampling points on one side of the substrate center line $L_{T\text{-}W}$ is n (which is an integer), the number of all sampling points when the light transmission section 22 scans the measuring target surface of the wafer W is expressed by 2n+1, including the sampling point P on the substrate center line $L_{T\text{-}W}$.

If a circumferential portion of the top ring 14 is located outwardly of the wafer W so as to block background light, the condition for the light transmission section 22 to be present within the measuring target surface of the wafer W at a first sampling time can be expressed by the following inequality (2), where $\omega_T$ represents an angular velocity of the polishing table 12. The integer n which satisfies this condition can be obtained from the following inequality (2).

$$\alpha - \omega_T T \leqq n\omega_T T < \alpha \tag{2}$$

That is, $$\frac{\alpha}{\omega_T T} - 1 \leqq n < \frac{\alpha}{\omega_T T}$$

If the light transmission section 22 and the proximity sensor 50 are located at the same angle with respect to the center $C_T$ of the polishing table 12, a time $t_S$ from when the proximity sensor 50 detects the dog 52 to when the first photodetector 60-1 starts storing electrical information in the first sampling cycle while the polishing table 12 makes one revolution, i.e., a sampling start time $t_S$, can be determined from the following equation (3).

$$\begin{aligned} t_S &= \frac{\theta}{\omega_T} - \left(nT + \frac{T+S}{2}\right) \\ &= \frac{\theta}{\omega_T} - \left(n + \frac{1}{2}\right)T - \frac{S}{2} \end{aligned} \tag{3}$$

In order to reliably clear the quantity of light stored in the photodetectors while the light transmission section 22 is located outside of the surface, being polished, of the wafer W, the data acquired in the first sampling cycle may be discarded. In this case, the sampling start time $t_S$ can be determined from the following equation (4).

$$\begin{aligned} t_S &= \frac{\theta}{\omega_T} - \left(nT + \frac{T+S}{2} + T\right) \\ &= \frac{\theta}{\omega_T} - \left(n + \frac{3}{2}\right)T - \frac{S}{2} \end{aligned} \tag{4}$$

The polishing state monitoring apparatus 20 starts its sampling operation based on the sampling start time $t_S$ thus determined. Specifically, the control unit 40 starts pulse lighting of the light source 30 after elapse of the time $t_S$ from the detection of the dog 52 by the proximity sensor 50, and controls the operation timing of the photodetectors of the spectroscope unit 36 so as to repeat a sampling operation on a cycle of the sampling period T. Reflection spectral data at each sampling point are generated by the spectral data generator of the control unit 40 and is transmitted to the processor 48. Based on the spectral data, the processor 48 determines a characteristic value of the surface, being polished, of the wafer W.

In the present embodiment, since the point P on the substrate center line $L_{T\text{-}W}$ which is on the path of the light transmission section 22 is always selected as a sampling point, the characteristic value at a given radial position on the surface of the substrate can repeatedly be measured each time the polishing table 12 makes one revolution. If the sampling period is constant, then the radial positions of measuring points on the surface of the substrate per revolution of the polishing table 12 become constant. Therefore, this measuring process is more advantageous in recognizing the situation of a remaining film on the wafer W than the case where the characteristic values at unspecific positions are measured. In particular, if the light transmission section 22 is arranged so as to pass through the center $C_W$ of the wafer W, then the center $C_W$ of the wafer W is always measured as a fixed point each time the polishing table 12 makes one revolution. Therefore, a more accurate grasp of a time variation of a remaining film situation of the wafer W can be realized.

If the continuous light source is used as the light source 30, since the respective photodetectors continuously store electrical information and start storing the electrical information at different times, the integer n is determined in a manner different from a pulsed light source. Specifically, when the first photodetector 60-1 starts storing electrical information, the light transmission section 22 needs to be present in the measuring target surface of the wafer W. Therefore, the inequality for determining the integer n is given as follows.

$$\alpha - \omega_T T \leqq n\omega_T T + \omega_T \frac{T+S}{2} < \alpha \quad (5)$$

That is, $$\frac{\left(\frac{\alpha}{\omega_T} - \frac{S}{2}\right)}{T} - \frac{3}{2} \leqq n < \frac{\left(\frac{\alpha}{\omega_T} - \frac{S}{2}\right)}{T} - \frac{1}{2}$$

The integer n can be determined from the above inequality (5), and the sampling start time $t_S$ can be determined based on the equation (3) or (4). As well as the case of using the pulsed light source, the polishing state monitoring apparatus 20 starts its sampling process based on the determined sampling start time $t_S$, and determines a characteristic value of the surface, being polished, of the wafer W from the spectral data at each sampling point. In the above example, certain conditions are established with respect to the timing of lighting the pulsed light source and the positional relationship between the light transmission section 22 and the proximity sensor 50. Even if these conditions are not met, n and $t_S$ can similarly be determined.

Next, a method of detecting the polishing end point based on the above-described spectral data will be described.

As an initial step, one or more wafers are polished by the above polishing apparatus, and the spectral data with respect to these wafers are obtained. The spectral data contain data showing reflection intensity (i.e., intensity of the reflected light) at each wavelength. The processor 48 calculates the characteristic value from the reflection intensity at each wavelength as follows.

The processor 48 calculates a first characteristic value X1(t) from a reflection intensity $\rho_{\lambda 1}(t)$ at a wavelength λ1 and a reflection intensity $\rho_{\lambda 2}(t)$ at a wavelength λ2 using:

$$X1(t)=\rho_{\lambda 1}(t)/(\rho_{\lambda_1}(t)+\rho_{\lambda 2}(t)) \quad (6)$$

where ρ represents a reflection intensity and t represents a polishing time. The two wavelengths λ1 and λ2 are selected in advance.

Similarly, the processor 48 calculates a second characteristic value X2(t) from a reflection intensity $\rho_{\lambda 3}(t)$ at a predetermined wavelength λ3 and a reflection intensity $\rho_{\lambda 4}(t)$ at a predetermined wavelength λ4 using:

$$X2(t)=\rho_{\lambda 3}(t)/(\rho_{\lambda 3}(t)+\rho_{\lambda 4}(t)) \quad (7)$$

As a film of the wafer is polished, the reflection intensities $\rho_{\lambda 1}(t)$, $\rho_{\lambda 2}(t)$, $\rho_{\lambda 3}(t)$, and $\rho_{\lambda 4}(t)$ change with certain periods that depend on the wavelength of the light. This is because of optical interference as a result of multiple reflection at a surface of the film and an interface between the film and an underlying film. Therefore, the first characteristic value X1(t) and the second characteristic value X2(t), determined by using the reflection intensities $\rho_{\lambda 1}(t)$, $\rho_{\lambda 2}(t)$, $\rho_{\lambda 3}(t)$, and $\rho_{\lambda 4}(t)$, also change periodically with the polishing time t (i.e., according to a decrease in the film thickness). Further, the period of the characteristic value varies depending on a combination of the wavelengths selected.

Figure 7:
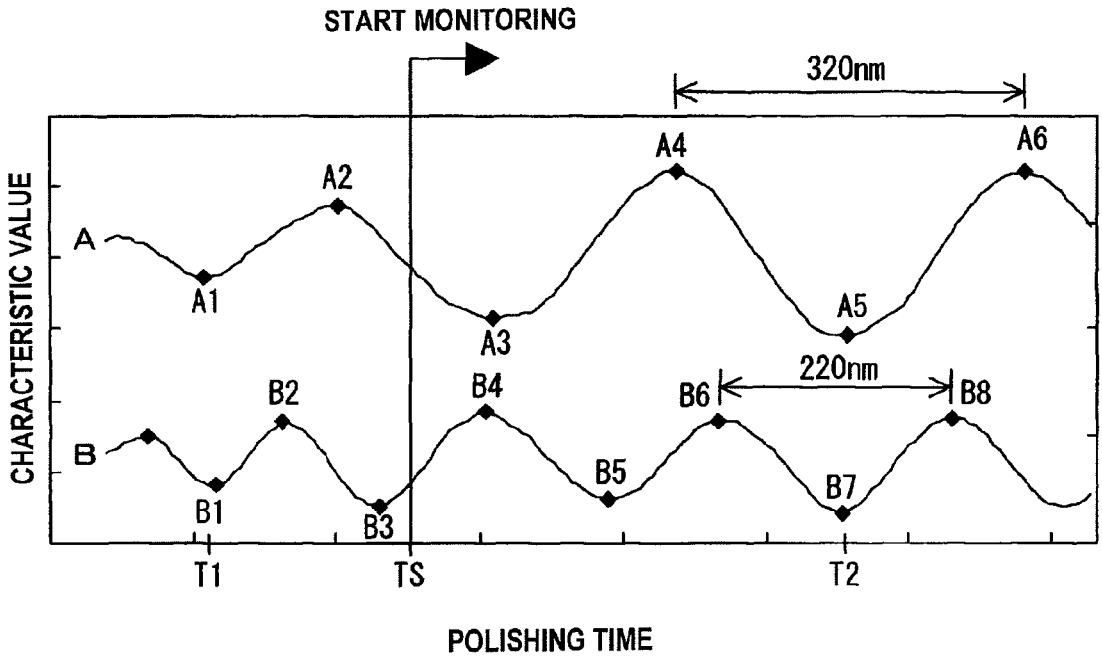
FIG. 7 is a graph for explaining a polishing end point detection method according to an embodiment of the present invention.

FIG. 7 is a graph showing loci (waveforms A and B) of the first characteristic value and the second characteristic value when polishing a film with an initial thickness of 1800 nm. In this example, a combination of 650 nm and 750 nm is selected as a combination of the wavelengths λ1 and λ2 for calculating the first characteristic value, and a combination of 450 nm and 470 nm is selected as a combination of the wavelengths λ3 and λ4 for calculating the second characteristic value. In this case, a thickness of the film (e.g., an oxide film) removed in a time interval between adjacent extremal points on the waveform A of the first characteristic value is about 320 nm, and a thickness of the film removed in a time interval between adjacent extremal points on the waveform B of the second characteristic value is about 220 nm. In this specification, the local maximum point and the local minimum point are referred to collectively as extremal point.

As shown in FIG. 7, the periods of the characteristic values X1(t) and X2(t) differ from each other. This is because the combination of the wavelengths (650 nm and 750 nm) selected for the first characteristic value differs from the combination of the wavelengths (450 nm and 470 nm) selected for the second characteristic value. In this manner, the wavelengths are selected such that the periods of the waveforms of the first characteristic value and the second characteristic value differ from each other. Where the period of the first characteristic value is represented by P1 and the period of the second characteristic value is represented by P2, a preferable ratio of P1 to P2 (i.e., P1/P2) is within a range of 0.6 to 0.9.

The polishing end point detection is performed using the waveform A of the first characteristic value and the waveform B of the second characteristic value according to the following procedure. At step 1, monitoring of the waveform A of the first characteristic value and the waveform B of the second characteristic value is started from a predetermined monitoring start time. At step 2, a point of time when a local minimum point of the waveform A and a local minimum point of the waveform B appear at the same time is detected. Further, at step 3, a subsequent extremal point of the waveform A or waveform B is detected if necessary. At step 4, the polishing operation is stopped when a predetermined period of time has elapsed from the detection time in step 3 if necessary. This procedure is stored in the processor 48 as a recipe for the polishing end point detection. The processor 48 monitors the first characteristic value and the second characteristic value during polishing of each wafer, and detects the polishing end point according to the above procedure.

An example of the above-described procedure will be described more specifically with reference to FIG. 7. After the polishing operation is started, the processor 48 starts monitoring of the waveform A of the first characteristic value and the waveform B of the second characteristic value at a predetermined monitoring start time TS (step 1), and detects a point of time T2 when a local minimum point of the waveform A and a local minimum point of the waveform B appear at substantially the same time (step 2). In the example shown in FIG. 7, a fifth local minimum point A5 of the waveform A and a seventh local minimum point B7 of the waveform B appear at substantially the same time. The processor 48 further detects a local maximum point A6 of the waveform A that appears after the point T2 (step 3), and determines the polishing end point based on a time when a predetermined period of time (e.g., five seconds) has elapsed from the detection time of the local maximum point A6 (step 4).

Depending on a target film thickness, the polishing end point may be set to a point of time when an extremal point appears after the local maximum point A6 is detected in step 3. Alternatively, the polishing end point may be established when an extremal point (e.g., a local maximum point B8) of the second characteristic value appears after the point T2. The predetermined period of time that is set in step 4 is preferably in a range of 0 second to 10 seconds. This is for the reason that a long period of time can cause an error in the resultant film thickness due to variations in polishing rate.

The monitoring start time is determined based on previously-obtained data on several wafers. More specifically, the monitoring start time is determined based on the data including waveforms of characteristic values and variations in predicted initial film thickness. The monitoring start time determined using the above data is used in polishing of product wafers (with different initial thicknesses) each having a structure identical to the wafers used in determining the monitoring start time.

It is necessary for determining the monitoring start time to eliminate an influence of the variation in the initial thickness so as not to cause an error in the polishing end point detection. The waveform at an initial stage of the polishing process may be unstable. Therefore, the monitoring start time is determined so as to avoid such an unstable period. In addition, it is necessary to avoid identifying in error a point T1 when local minimum points of the waveform A and the waveform B appear simultaneously as a point of satisfying the detection condition in step 2. Therefore, the monitoring start time is set to a point after the point T1.

When polishing a wafer with a small initial thickness, the waveform may begin after the point T1. In such a case, if a time interval between the polishing start time and the monitoring start time is long, the monitoring may be started after the point T2 and a failure in the detection of the point T2 can occur. Therefore, it is necessary to set the monitoring start time before the point T2 which is a reference point for the polishing end point detection.

In this manner, an appropriate monitoring start time is set based on maximum value and minimum value of the predicted initial thicknesses. A time difference between the point T1 and the point T2 is relatively large. Therefore, it is always possible to establish the appropriate monitoring start time. In a case where an extremal point of the waveform A and an extremal point of the waveform B appear at the same time between the point T1 and the point T2, the monitoring start time can be set to such a point of time. In the example shown in FIG. 7, the monitoring start time can be set to a point of time when an local minimum point A3 and a local maximum point B4 appear at substantially same time.

A time difference is used as a criterion for determining whether the local minimum points (or local maximum points) of the waveform A and the waveform B appear at substantially the same time. Specifically, when the local minimum points of the waveform A and the waveform B appear within a predetermined time difference (e.g., −2.5 seconds to 2.5 seconds), the processor 48 judges that the local minimum points (or local maximum points) of the waveform A and the waveform B have appeared at substantially the same time.

A relative position between the waveform A of the first characteristic value and the waveform B of the second characteristic value is constant irrespective of the initial film thickness and the polishing rate. Therefore, according to the above-described polishing end point detection process, a specific extremal point (in other words, a point when a specific film thickness is reached) can be detected in step 2 without being affected by the initial film thickness. Then, step 3 and step 4 are performed properly after the detection of the predetermined extremal point so as to obtain a target film thickness. According to this method, an accurate polishing end point can be detected without being affected by the initial film thickness and the polishing rate.

In the above-described embodiment, the processor 48 performs monitoring of the waveforms A and B so as to detect a point of time when the local minimum points appear at substantially the same time. Alternatively, depending on the wavelengths selected, the point to be detected may be a point of time when local maximum points appear at substantially the same time or when a local maximum point and a local minimum point appear at substantially the same time.

A phase difference between the waveforms A and B of the first characteristic value and the second characteristic value varies depending on the wavelengths selected. Therefore, the point to be detected may be a point of time when extremal points appear within a predetermined time difference. For example, a condition for detecting the point can be such that the local extremal points of the first and second characteristic values appear within a time difference ranging from 5 seconds to 10 seconds. When the predetermined time difference is set in a range of −2.5 seconds to 2.5 seconds, this time difference corresponds to the above detection condition in which the local extremal points appear at substantially the same time.

While the characteristic value, calculated from the reflection intensity, is used to detect the polishing end point in the above-described embodiment, the reflection intensity itself may be used in the polishing end point detection. In this case, a first reflection intensity and a second reflection intensity at different wavelengths are used. Further, a differential value (or derivative) of the characteristic value or reflection intensity may be used for the polishing end point detection. In these cases also, the same procedure as described above can be used to detect the polishing end point.

Further, while two wavelengths are selected for calculating each characteristic value in the above-described embodiment, three or more wavelengths may be used. In this case, a characteristic value X(t) can be calculated using:

$$X(t)=\rho_{\lambda 1}(t)/(\rho_{\lambda_1}(t)+\rho_{\lambda 2}(t)+\ldots+\rho_{\lambda n}(t)) \quad (8)$$

where n represents the number of wavelengths used.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents. For example, the present invention can be applied not only to polishing of a surface of a substrate, but also to polishing of a periphery of a substrate.

What is claimed is:

1. A method for detecting a polishing end point, said method comprising:

applying light to a surface of a substrate during polishing of the substrate;

receiving reflected light from the surface of the substrate;

monitoring a first characteristic value and a second characteristic value calculated from reflection intensities at different wavelengths;

detecting a point of time when an extremal point of the first characteristic value and an extremal point of the second characteristic value appear within a predetermined time difference; and determining a polishing end point based on said point of time.

2. The method according to claim 1, wherein said polishing end point is said point of time when an extremal point of the first characteristic value and an extremal point of the second characteristic value appear within said predetermined time difference.

3. The method according to claim 1, wherein said polishing end point is a point of time when a predetermined time has elapsed from said point of time when an extremal point of the first characteristic value and an extremal point of the second characteristic value appear within said predetermined time difference.

4. The method according to claim 1, further comprising:

after detecting said point of time, detecting a predetermined extremal point of the first characteristic value or the second characteristic value, wherein said determining a polishing end point based on said point of time comprises determining a polishing end point based on a point of time when said predetermined extremal point is detected.

5. The method according to claim 4, wherein said polishing end point is said point of time when said predetermined extremal point is detected.

6. The method according to claim 4, wherein said polishing end point is a point of time when a predetermined time has elapsed from said point of time when said predetermined extremal point is detected.

7. The method according to claim 1, wherein said point of time when an extremal point of the first characteristic value and an extremal point of the second characteristic value appear within the predetermined time difference is a point of time when an extremal point of the first characteristic value and an extremal point of the second characteristic value appear at substantially the same time.

8. A method for detecting a polishing end point, said method comprising:

applying light to a surface of a substrate during polishing of the substrate;

receiving reflected light from the surface of the substrate;

monitoring a first reflection intensity and a second reflection intensity at different wavelengths;

detecting a point of time when an extremal point of the first reflection intensity and an extremal point of the second reflection intensity appear within a predetermined time difference; and determining a polishing end point based on said point of time.

9. The method according to claim 8, wherein said polishing end point is said point of time when an extremal point of the first reflection intensity and an extremal point of the second reflection intensity appear within said predetermined time difference.

10. The method according to claim 8, wherein said polishing end point is a point of time when a predetermined time has elapsed from said point of time when an extremal point of the first reflection intensity and an extremal point of the second reflection intensity appear within said predetermined time difference.

11. The method according to claim 8, further comprising;

after detecting said point of time, detecting a predetermined extremal point of the first reflection intensity or the second reflection intensity, wherein said determining a polishing end point based on said point of time comprises determining a polishing end point based on a point of time when said predetermined extremal point is detected.

12. The method according to claim 1, wherein said polishing end point is said point of time when said predetermined extremal point is detected.

13. The method according to claim 1, wherein said polishing end point is a point of time when a predetermined time has elapsed from said point of time when said predetermined extremal point is detected.

14. The method according to claim 8, wherein said point of time when an extremal point of the first reflection intensity and an extremal point of the second reflection intensity appear within the predetermined time difference is a point of time when an extremal point of the first reflection intensity and an extremal point of the second reflection intensity appear at substantially the same time.

* * * * *

UNITED STATES PATENT AND TRADEMARK OFFICE

CERTIFICATE OF CORRECTION

PATENT NO. : 8,157,616 B2
APPLICATION NO. : 12/476427
DATED : April 17, 2012
INVENTOR(S) : Noburu Shimizu et al.

It is certified that error appears in the above-identified patent and that said Letters Patent is hereby corrected as shown below:

IN THE CLAIMS

In column 14, claim 12, line 22, please change “claim 1,” to --claim 11,--.

In column 14, claim 13, line 25, please change “claim 1,” to --claim 11,--.

Signed and Sealed this
Twenty-sixth Day of June, 2012

David J. Kappos

David J. Kappos
*Director of the United States Patent and Trademark Office*